US006436497B1

(12) United States Patent
Takahashi et al.

(10) Patent No.: US 6,436,497 B1
(45) **Date of Patent: *Aug. 20, 2002**

(54) POLYESTER STRETCH BLOW BOTTLE AND PRODUCTION THEREOF

(75) Inventors: Koji Takahashi; Isao Hata, both of Yamaguchi (JP)

(73) Assignee: Mitsui chemicals, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/041,019

(22) Filed: Mar. 12, 1998

(30) Foreign Application Priority Data

Mar. 13, 1997 (JP) ..... 9-058658

(51) Int. Cl.[7] ..... B65D 23/00

(52) U.S. Cl. ..... 428/35.7; 428/36.92; 528/194; 528/308.6; 528/308.8; 264/523; 264/532

(58) Field of Search ..... 428/35.7, 36.92; 525/444; 215/371, 379; 528/194, 308.6, 308.8; 264/523, 532

(56) References Cited

U.S. PATENT DOCUMENTS 4,578,295 A * 3/1986 Jabarin ..... 428/35
4,837,115 A * 6/1989 Igarashi et al. ..... 428/36.92
5,039,780 A * 8/1991 Hashimoto et al. ..... 528/194
5,556,675 A * 9/1996 Yamamoto et al. ..... 428/36.92

FOREIGN PATENT DOCUMENTS

EP 174265 A * 3/1986

OTHER PUBLICATIONS

Derwent Abstract of Japanese Patent JP 61072051A; Polyester Composition . . . ; Imuda, Shinchi, Apr. 14, 1986.*

Derwent Abstract of Japanense Patent JP 61043655A; Gas container . . . ; Yoshida, Hirohiko, Mar. 3, 1986.*

* cited by examiner

*Primary Examiner*—Rena L. Dye
(74) *Attorney, Agent, or Firm*—Birch, Stewart, Kolasch & Birch, LLP

(57) ABSTRACT

A stretch blow bottle made from a polyester resin composition which comprises: (A) 60 to 99% by weight of a polyethylene terephthalate resin and (B) 1 to 40% by weight of a polyethylene isophthalate resin, wherein 300 square microns of a section exposed by cutting the neck of the bottle contains less than one particle of the polyethylene isophthalate resin (B) having a diameter of 0.1 micron or above in the polyethylene terephthalate resin (A) as the matrix.

8 Claims, 1 Drawing Sheet

POLYESTER STRETCH BLOW BOTTLE AND PRODUCTION THEREOF

BACKGROUND OF THE INVENTION

1. Field of the Invention

This invention relates to a stretch blow bottle made from a polyester resin composition and production thereof. More particularly, The invention relates to a stretch blow bottle made from a polyester resin composition comprising a polyethylene terephthalate resin and a polyethylene isophthalate resin, and a process for producing the same.

2. Description of the Prior Art

Plastics bottles which are not deformed when filled with beverages, but remain self-supported are widely used as containers for various kinds of beverages, such as carbonated beverages, carbonated beverages containing fruit juice, soft drinks, mineral water and tea. While various kinds of plastics have been used for making such bottles, stretch blow bottles made from a polyethylene terephthalate resin are, among others, widely used owing to their high levels of transparency, gas-barrier property, heat resistance and mechanical strength.

The bottled beverages leaving a bottling plant are distributed through many routes before they are sold by retail stores to consumers. The known stretch blow bottles made from a polyethylene terephthalate resin are, however, not satisfactory in gas-barrier property, but if the bottled beverages are left to stand for a considerably long time, it is likely that the release of carbon dioxide from the beverages may result in the failure to maintain an initial gas pressure, or that oxygen may enter the bottles and deteriorate their contents.

Japanese Patent Publications Nos. 1-49384 and 5-13987, for example, propose the blending of a polyethylene terephthalate resin with a polyethylene isophthalate resin to improve the gas-barrier property of the former. Such a blend has shown an improved gas-barrier property and a high transparency. However, it has been likely that, if a bottle produced therefrom is dropped on the ground, or on a concrete floor, it may have its bottom separated in a layer at the portion at which the bottle hits against the floor, as if abraded, and allow its contents to leak out. Similarly, a layer of separation has also been found in a section exposed by cutting the body of such a bottle with a knife.

SUMMARY OF THE INVENTION

The present inventors have molded a preform from a resin composition comprising a polyethylene terephthalate resin and a polyethylene isophthalate resin and studied the microscopic dispersion of the polyethylene isophthalate resin in the polyethylene terephthalate resin as the matrix in the preform prior to its stretch blow molding in order to find a solution to the problems as pointed out above with respect to the conventional stretch blow bottle made of a polyester resin composition. As results, they have found that if the microscopic dispersion of the polyethylene isophthalate resin in the matrix of the polyethylene terephthalate resin fulfils the specific conditions, the resultant resin composition exhibits a high gas-barrier property and gives by stretch blow molding a self-supported bottle of high mechanical strength not having the bottom separated in a layer, even if it may be dropped on the ground, or a concrete floor.

It is, therefore, an object of this invention to provide a self-supported stretch blow bottle for a beverage made from a polyester resin composition, and having a high gas-barrier property and a high mechanical strength including breaking and impact strength.

It is another object of the invention to provide a process for producing such a polyester stretch blow bottle.

The invention provides a stretch blow bottle made from a polyester resin composition which comprises: (A) 60 to 99% by weight of a polyethylene terephthalate resin and (B) 1 to 40% by weight of a polyethylene isophthalate resin, wherein 300 square microns of a section exposed by cutting the neck of the bottle contains less than one particle of the polyethylene isophthalate resin (B) having a diameter of 0.1 micron or above in the polyethylene terephthalate resin (A) as the matrix.

The invention further provides a process for producing a polyester stretch blow bottle which comprises:

melt kneading under a high shear load a resin composition comprising (A) 60 to 99% by weight of a polyethylene terephthalate resin and (B) 1 to 40% by weight of a polyethylene isophthalate resin;

forming a preform from it at a temperature of 250° C. to 310° C.; and stretch blow molding the preform;

wherein 300 square microns of a section exposed by cutting any portion of the preform contains less than one particle of the polyethylene isophthalate resin (B) having a diameter of 0.1 micron or above in the polyethylene terephthalate resin (A) as the matrix.

The bottle of the invention has a high gas-barrier property owing to the microscopic dispersion of the polyethylene isophthalate resin as defined hereinabove in the matrix of the polyethylene terephthalate resin. It also exhibits a high level of transparency and a high level of mechanical strength. In addition, even if it is dropped on the ground, or on a concrete floor, it does not have the bottom separated in a layer at which it hits against the ground or floor. For example, no bottle of the invention having a capacity of 100 ml or above, and filled substantially with water has a cracked bottom, even if it may be dropped five times on a concrete floor from a height of 2 m with its bottom down.

Thus, the bottle of the invention is suitable for use in containing, among others, a carbonated beverage, or any other beverage that is liable to deterioration, such as a fruit juice, or vitamin drink. The used bottles can easily be melted, and reused in making bottles, or other molded products.

Other features and advantages of the invention will become apparent from the following description and the accompanying drawing.

DETAILED DESCRIPTION OF THE INVENTION

Figure 1:
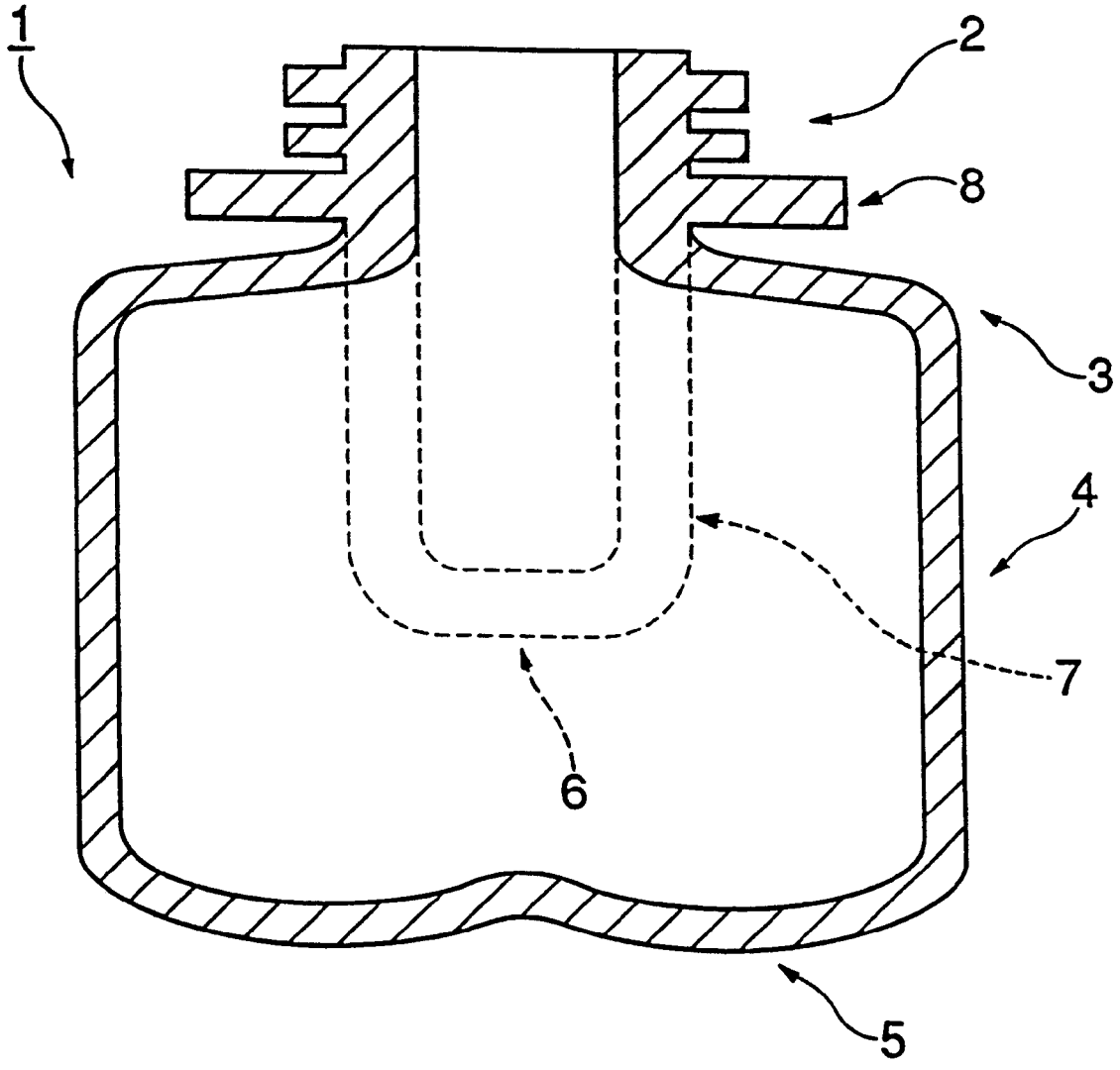
FIG. 1 is a front elevational view in section of a bottle made from a polyester resin composition and embodying the invention.

The polyethylene terephthalate resin (A) used in the invention is a known resin produced from terephthalic acid as a dicarboxylic acid component and ethylene glycol as a dihydroxy compound component by esterification (or ester interchange) and liquid-phase polycondensation and solid-phase polycondensation, if required, in this sequence.

The polyethylene terephthalate resin used in the invention contains on a molar basis at least 80% of terephthalic acid component relative to a total of 100% of the dicarboxylic acid component and has an intrinsic viscosity [η] of 0.5 to 1.5 dl/g, as measured in o-chlorphenol at a temperature of 25° C.

The polyethylene terephthalate resin may contain on a molar basis not more than 20%, preferably not more than 10%, and more preferably not more than 5% of a second dicarboxylic acid component other than terephthalic acid relative to a total of 100% of the dicarboxylic acid component.

The polyethylene terephthalate resin may further contain on a molar basis not more than 20%, preferably not more than 10%, and more preferably not more than 5% of a second dihydroxy compound component other than ethylene glycol relative to a total of 100% of dihydroxy compound component.

Examples of the second dicarboxylic acid are aromatic dicarboxylic acids such as phthalic, isophthalic, naphthalenedicarboxylic, diphenyldicarboxylic and diphenoxy-ethanedicarboxylic acids; aliphatic dicarboxylic acids such as adipic, sebacic, azelaic and decanedicarboxylic acids; and alicyclic dicarboxylic acids such as cyclohexanedicarboxylic acid.

Examples of the second dihydroxy compound are aliphatic glycols such as diethylene glycol, trimethylene glycol, propylene glycol, tetramethylene glycol, neopentyl glycol, hexamethylene glycol and dodecamethylene glycol; alicyclic glycols such as cyclohexanedimethanol; and aromatic glycols such as bisphenols, hydroquinone and 2,2-bis (4-βhydroxy-ethoxyphenyl)propane.

Isophthalic acid is, among others, preferred as the second dicarboxylic acid, and diethylene glycol or cyclohexanedimethanol as the second dihydroxy compound.

The polyethylene terephthalate resin used in the invention may contain the second dicarboxylic acid component or the second dihydroxy compound component therein as mentioned above, and is a substantially linear polyester having ester linkages formed either by ethylene terephthalate units alone, or a random arrangement of ethylene and dihydroxyethylene terephthalate units. Its substantial linearity is confirmed by its complete dissolution in o-chlorophenol.

The polyethylene terephthalate resin used in the invention has an intrinsic viscosity [η] of usually 0.5 to 1.5 dl/g, preferably 0.6 to 1.5 dl/g, and more preferably 0.7 to 1.2 dl/g, as measured in o-chlorophenol at 25° C. It has a melting point of usually 210° C. to 265° C., and preferably 220° C. to 260° C. and a glass transition temperature of usually 50° C. to 120° C. and preferably 60° C. to 100° C.

The polyethylene isophthalate resin (B) used in the invention is produced from isophthalic acid as a dicarboxylic acid component and ethylene glycol as a dihydroxy compound component.

The polyethylene isophthalate resin used in the invention contains on a molar basis at least 50% of isophthalic acid component relative to a total of 100% of the dicarboxylic acid component and has an intrinsic viscosity [η] of 0.5 to 1.0 dl/g, as measured in o-chlorophenol at a temperature of 25° C.

The polyethylene isophthalate resin may contain on a molar basis less than 50%, preferably not more than 30%, and more preferably not more than 20% of a second dicarboxylic acid component other than isophthalic acid relative to a total of 100% of dicarboxylic acid component.

The polyethylene isophthalate resin may further contain on a molar basis less than 50%, preferably not more than 30%, and more preferably not more than 20% of a second dihydroxy compound component other than ethylene glycol relative to a total of 100% of dihydroxy compounds.

Examples of the second dicarboxylic acid are aromatic dicarboxylic acids such as o-phthalic, terephthalic, naphthalenedicarboxylic, diphenyldicarboxylic and diphenoxy-ethanedicarboxylic acids; aliphatic dicarboxylic acids such as adipic, sebacic, azelaic and decanedicarboxylic acids; and alicyclic dicarboxylic acids such as cyclohexanedicarboxylic acid.

Examples of the second dihydroxy compound are aliphatic glycols such as diethylene, trimethylene, propylene, tetramethylene, neopentyl, hexamethylene and dodecamethylene glycols; alicyclic glycols such as cyclohexanedimethanol; glycols having aromatic nuclei such as 1,3-bis(2-hydroxy-ethoxy)benzene, 1,2-bis(2-hydroxyethoxy) benzene and 1,4-bis(2-hydroxyethoxy)benzene; and aromatic dihydroxy compounds such as bisphenols, hydroquinone and 2,2-bis(4-β-hydroxy-ethoxyphenyl)propane.

Terephthalic acid is, among others, preferred as the second dicarboxylic acid, and diethylene glycol or 1,3-bis(2-hydroxyethoxy)benzene as the second dihydroxy compound.

The polyethylene isophthalate resin used in the invention may further contain a polyfunctional hydroxy compound having at least three hydroxyl groups or a polyfunctional carboxylic acid having at least three carboxyl groups. Thus, the polyethylene isophthalate resin may contain on a molar basis 0.05 to 0.40 molar parts, preferably 0.1 to 0.35 molar parts, and more preferably 0.20 to 0.35 molar parts of any such polyfunctional hydroxy compound, or any such polyfunctional carboxylic acid relative to 100 molar parts of the dicarboxylic acid component.

Glycerol, 1,1,1-trimethylolpropane or 1,1,1-trimethylolethane can, for example, be used as the polyfunctional hydroxy compound, though 1,1,1-trimethylol-propane is, among others, preferred. Pyromellitic anhydride or trimellitic acid can, for example, be used as the polyfunctional carboxylic acid.

The polyethylene isophthalate resin used in the invention has an intrinsic viscosity [η] of usually 0.5 to 1.0 dl/g, and preferably 0.65 to 0.95 dl/g, as measured in o-chlorophenol at 25° C. The polyethylene isophthalate resin has a glass transition temperature of usually 50° C. to 75° C., and preferably 55° C. to 70° C.

The polyethylene isophthalate resin used in the invention as mentioned above can be produced by the same process as what is employed for producing the known polyethylene terephthalate resin.

The stretch blow bottle of the invention is formed from a polyester resin composition which comprises (A) 60 to 99%, preferably 80 to 97%, and more preferably 85 to 95%, by weight of a polyethylene terephthalate resin and (B) 1 to 40%, preferably 3 to 20%, and more preferably 5 to 15%, by weight of a polyethylene isophthalate resin.

The proportions of the two resins (A) and (B) as mentioned above ensure that the polyethylene isophthalate resin (B) be finely dispersed in the polyethylene terephthalate resin (A) as a matrix, and that the resulting resin composition has a high level of gas-barrier property, as well as high levels of moldability, heat resistance and impact strength.

According to the invention, a mixture of the polyethylene terephthalate resin (A) and the polyethylene isophthalate resin (B) is melt kneaded, and after or while it is melt kneaded, a preform is formed therefrom, and the preform is then biaxially stretch blow molded to provide a bottle.

According to an important aspect of the invention, the dispersion or distribution of the polyethylene isophthalate resin (B) in the polyethylene terephthalate resin (A) as the matrix in the preform has a significant bearing on the gas-barrier property and impact strength of the stretch blow bottle which is formed.

The dispersion of the polyethylene isophthalate resin in the neck portion of the stretch blow bottle produced according to the invention is substantially equal to that in any portion of the preform.

According to the invention, it is essentially important that 300 square microns of a section obtained by cutting any portion of the preform (or neck portion of the stretch blow bottle formed therefrom) contains particles of the polyethylene isophthalate resin (B) in the matrix of the polyethylene terephthalate resin (A), but the proportion of the particles of the polyethylene isophthalate resin (B) having a diameter of 0.1 micron or above in the polyethylene terephthalate resin (A) as the matrix is very small.

That is, 300 square microns of a section obtained by cutting any portion of the preform (or neck portion of the stretch blow bottle formed therefrom) contains less than one particle of the polyethylene isophthalate resin (B) having a diameter of 0.1 micron or above in the polyethylene terephthalate resin (A) as the matrix.

The proportion of the particles of the polyethylene isophthalate resin (B) having a diameter of 0.1 micron or above in the matrix of the polyethylene terephthalate resin (A) is determined by cutting the neck portion of the bottle to expose a section thereof, allowing it to stand in an atmosphere at a temperature of 120° C. for two hours and then in chloroform at room temperature (20° C.) for five hours, and examining it through an electron microscope.

According to the process of the invention, a preform is formed by melt kneading a mixture of the polyethylene terephthalate resin (A) and the polyethylene isophthalate resin (B) under a stronger shear force than what has hitherto been employed, by using an extruder having a sufficiently strong shear force.

It is undesirable to employ a higher kneading temperature than what has hitherto been employed, since a bottle having a higher acetaldehyde content, or a hue of lower quality is likely to be produced.

The kneading time is also of great importance. A long kneading time may improve the dispersion of the polyethylene isophthalate resin (B), but is not recommended, since a bottle having a higher acetaldehyde content, or a hue of lower quality is likely to be produced, as is likely to result from a high kneading temperature.

The process of the invention is, therefore, carried out by employing a kneading temperature of from 270° C. to 315° C., and preferably from 280° C. to 310° C. and a kneading time of from 60 seconds to 600 seconds, preferably from 70 seconds to 400 seconds, and most preferably from 90 seconds to 300 seconds.

As regards an extruder having a high shear force, it is possible to use, for example, an extruder having a Dulmage screw, an extruder having a screw with a pin in its metering portion, an extruder having a polygonal cylinder section (such as HM extruder of Mitsubishi Heavy Industries, Ltd.), or a twin-screw extruder. An extruder having a Dulmage screw is preferred for practical use, since it is less expensive.

The preform may be formed by employing a separate molding machine after a mixture of the polyethylene terephthalate resin (A) and the polyethylene isophthalate resin (B) has been melt kneaded in a kneader, as mentioned hereinbefore. More specifically, the resins (A) and (B) are melt kneaded in a kneader to prepare a resin composition, and then it is molded to a preform in the form of a test tube (or a closed-end parison) by using an injection molding machine.

It is alternatively possible to use a combined kneader and molding machine to melt knead the resins and form a preform in situ.

In either event, when a preform is prepared from a mixture or a composition of the polyethylene terephthalate resin (A) and the polyethylene isophthalate resin (B), it is necessary that the process of the invention involves a step of melt kneading the two resins and the step is carried out under the conditions defined hereinbefore.

It is further necessary that a preform is molded at a temperature of from 250° C. to 310° C. That is, a mixture or a resin composition of the two resins is melted by heating to a temperature equal to or above the melting point of the polyethylene terephthalate resin, or a temperature of, say, from 250° C. to 310° C., and preferably from 260° C. to 300° C., when it is shaped into a preform.

Referring to the extrusion molding of a preform, the molten resin composition is extruded into a tubular shape, and is then rapidly cooled in a water tank, or by water sprinkling, or through a sizing die to form a tube of an amorphous polyester resin and a bottom is welded to, or formed on the tube to make a preform in the form of a test tube.

The preform is biaxially stretch blow molded in a metal mold to provide a stretch blow bottle according to the invention. The preform is heated to a temperature of 90° C. to 120° C. when it is stretch blow molded to form a bottle. It is stretched at a stretch ratio by area of from 6 to 15 times, and preferably from 8 to 14 times. The stretch ratio (by area) means the biaxial stretch ratio obtained as the product of the longitudinal and transverse stretch ratios.

Stretch blow molding is carried out by using a fluid having a temperature of from 10° C. to 400° C., and preferably from 20° C. to 300° C. The fluid may, for example, be air, nitrogen, steam, or water, though air is preferred from a practical standpoint.

The biaxially stretch blow molded bottle is heat set to acquire a crystallization degree of from 25 to 60%, and preferably from 25 to 50% in the body portion and thereby an improved heat resistance.

FIG. 1 shows in section a self-supported stretch blow bottle embodying this invention and made from a polyester resin composition. The bottle has a neck portion 2 having a flange 8, a shoulder 3 and a body 4 extending from the neck portion and shaped by biaxially stretch blow molding, and a bottom 5. The bottle is made by biaxially stretch blow molding the body portion of a preform 7 in the form of a test tube (or closed-end parison) including the neck portion 2 and the bottom 6.

As is obvious from FIG. 1, the neck portion 2 of the preform 7 is substantially not stretched. It is, therefore, possible to consider that the dispersion of the polyethylene isophthalate resin (B) in the polyethylene terephthalate resin (A) as the matrix in the neck portion is equal to the dispersion of the polyethylene isophthalate resin in the preform.

According to the invention, the dispersion of the polyethylene isophthalate resin in the polyester resin composition which forms the bottle is evaluated by a method as defined hereinbefore and it is necessary that the dispersion fulfils the conditions as defined hereinbefore.

The bottle of the invention preferably has a capacity of 100 ml or larger in order to have its advantages manifested clearly. It has a high level of transparency, since its body usually has a haze of less than 5% as measured by a method prescribed in ASTM D 1003.

The invention will now be described in further detail based on examples embodying it, though it is to be understood that the following description is not intended for limiting the scope of the invention. Explanation will first be made of the methods and standards which were employed for the evaluation of the bottles as molded.

(i) Dispersion of the Resins:

A section was cut from a neck portion of each bottle and left to stand in an atmosphere at a temperature of 120° C. for two hours, whereby white crystals were formed. The cut section had its surface flattened, and was dipped in chloroform and left to stand at normal temperature for five hours. Vapor of platinum-palladium was deposited on the flattened surface and it was examined through a scanning electron microscope, whereby the number of pores having a diameter of 0.1 micron or above in an area of 300 square microns in the cut surface was determined as a measure of the dispersion of the polyethylene isophthalate resin in the neck portion of the bottle.

The results of evaluation were classified by the following standards:

Good: When less than one pore having a diameter of 0.1 micron or above was found; or Bad: When one or more such pores were found.

(ii) Drop Strength:

The bottle was filled with water substantially to its full capacity, and closed tightly by an aluminum or plastic plug. It was dropped five times on a concrete floor from a height of 2 m with the bottom down, and the bottom was examined.

Good: When no water leaked; or

Bad: When water leaked.

(iii) Gas-Barrier Property:

After the weight had been measured, the bottle was purged with carbon dioxide. The bottle was quickly charged with dry ice in an amount creating an internal pressure of 5 atm., was tightly closed and was strongly shaken to cause the dry ice to gasify. The weight of carbon dioxide in the bottle was calculated from the weight of the tightly closed bottle and the initial weight of the bottle and the plug.

The bottle was stored in an atmosphere having a temperature of 23° C. plus or minus 1° C. until the weight of carbon dioxide in the bottle dropped to 82.5% of the initial weight, and the number of days was recorded as a measure of the gas-barrier property of the bottle.

(iv) Acetaldehyde Content:

The bottle as molded was quickly purged with nitrogen, was tightly closed, and was stored in an atmosphere at a temperature of 23° C. plus or minus 1° C. for 24 hours plus or minus 1 hour. Then, the amount of acetaldehyde in the bottle was determined by gas chromatography.

(v) Separation Resistance of the Body:

A knife was applied to the body of the bottle at right angles thereto to make four cuts spaced apart from one another by a distance of 1 cm longitudinally of the bottle. The bottle was compressed by hand, and examined for any portion separated completely from its body between any two adjoining cuts.

Good: When there was no completely separated portion between any two adjoining cuts; or Bad: When there was one or more such separated portions.

EXAMPLE 1

A closed-end parison (or preform) was formed by use of an injection molding machine, Model M-70B of Meiki Manufacturing Co., Ltd. from a polyester resin composition comprising 90% by weight of a polyethylene terephthalate resin (homopolymer) having an intrinsic viscosity [η] of 0.82 dl/g (hereinafter referred to as PET-1), 10% by weight of a polyethylene isophthalate resin (copolymer) containing on a molar basis 90% of isophthalic acid and 10% of terephthalic acid as the dicarboxylic acid component and 85% of ethylene glycol and 15% of 1,3-bis(2-hydroxyethoxy)benzene as the dihydroxy compound component and further containing on a molar basis 0.32 parts of 1,1,1-trimethylolpropane relative to 100 parts of the dicarboxylic acid component, and having an intrinsic viscosity [η] of 0.82 dl/g (hereinafter referred to as PIB-1) and 150 ppm of magnesium stearate.

The injection molding machine used had a screw having a compression ratio of 1.5 and a Dulmage type mixing portion formed by three flights at its end (hereinafter referred to as screw 1). The molding temperature was 290° C. and the molding cycle was 33 seconds.

The molding machine was also equipped with an infrared heater for heating the preform. The preform was heated until the middle portion of the body had a surface temperature of 100° C. to 110° C. and it was biaxially stretch blow molded at a stretch ratio by area of 11 times in a molding machine, Model LB-01 of CORPOPLAST to yield a bottle having a capacity of 500 ml for a carbonated beverage as shown in FIG. 1. The blow mold was held at normal temperature, and the bottle as molded was removed from the mold after five seconds of contact with it, and after a molding cycle of 60 seconds.

The bottle was examined for the dispersion of the resins in the neck portion, and the dropping strength, gas-barrier property, acetaldehyde content and separation resistance by the methods as described before. The results are shown in Tables 1 and 2.

EXAMPLE 2

A preform was formed, and the preform was then stretch blow molded into a bottle by employing a screw having a compression ratio of 2.7 (screw 2), injection molding the preform at a temperature of 275° C. and otherwise repeating Example 1. The bottle was likewise evaluated. The results are shown in Tables 1 and 2.

EXAMPLE 3

A bottle was produced by employing a polyethylene terephthalate resin (A) containing on a molar basis 2% of isophthalic acid as a second dicarboxylic acid component relative to a total of 100% of the dicarboxylic acid component (PET-2) and otherwise repeating Example 1. The bottle was likewise evaluated. The results are shown in Tables 1 and 2.

EXAMPLE 4

A bottle was made by employing a polyethylene isophthalate resin (B) containing on a molar basis 90% of isophthalic acid and 10% of terephthalic acid as the dicarboxylic acid component and only ethylene glycol as the dihydroxy compound component and having an intrinsic viscosity [η]

of 0.65 dl/g (PIB-2) and otherwise repeating Example 1. The bottle was likewise evaluated. The results are shown in Tables 1 and 2.

EXAMPLE 5

A bottle was produced by employing a polyester resin composition comprising 80% by weight of the polyethylene terephthalate resin (PET-1) and 20% by weight of the polyethylene isophthalate resin (PIB-1) and otherwise repeating Example 1. The bottle was likewise evaluated. The results are shown in Tables 1 and 2.

COMPARATIVE EXAMPLE 1

A bottle was produced by employing a screw of the whole pitch metering type (screw 3), injection molding a preform at a temperature of 275° C. and otherwise repeating Example 1. The bottle was likewise evaluated. The results are shown in Tables 1 and 2.

COMPARATIVE EXAMPLE 2

A bottle was produced by employing a polyester resin composition consisting solely of the polyethylene terephthalate resin (PET-1) and otherwise repeating Example 1. The bottle was likewise evaluated. The results are shown in Tables 1 and 2.

What is claimed is:

1. A stretch blow bottle obtainable by the process comprising:

melt-kneading (A) 60 to 99% by weight of a polyethylene terephthalate resin and (B) 1 to 40% by weight of a polyethylene isophthalate resin comprising dicarboxylic acid components and dihydroxy compound components under shear force using an extruder having a Dulmage screw, an extruder having a screw with a pin in its metering portion, an extruder having a polygonal cylinder section or a twin-screw extruder at a temperature of from 270° C. to 315° C. for a duration of from 60 seconds to 600 seconds, wherein the polyethylene isophthalate resin (B) comprises an isophthalic acid component, a terephthalic acid component, an ethylene glycol component and a 1,3-bis(2-hydroxethoxy) benzene component and the isophthalic acid component is contained in an amount of at least 50% on a molar basis relative to a total of 100% of the dicarboxylic acid components and the ethylene glycol component in an amount of not less than 50% on a molar basis relative to a total of 100% of the dihydroxy compound components;

forming a preform from the resulting melt-kneaded mixture of the resins at a temperature of 250° C. to 310° C.; and stretch blow molding the preform to provide a stretch blow bottle wherein 300 square microns of a section

TABLE 1

| | | Polyester Resin Composition (% by weight) | | | | Time of Melt Kneading of Resin Composition | Injection Molding of Preform | | |
|---|---|---|---|---|---|---|---|---|---|
| | | PET-1 | PET-2 | PIB-1 | PIB-2 | (seconds) | Molding Temperature (° C.) | Molding Cycle (seconds) | Screw Type |
| Example | 1 | 90 | | 10 | | 100 | 290 | 33 | 1 |
| | 2 | 90 | | 10 | | 250 | 275 | 33 | 2 |
| | 3 | | 90 | 10 | | 100 | 290 | 33 | 1 |
| | 4 | 90 | | | 10 | 100 | 290 | 33 | 1 |
| | 5 | 80 | | 20 | | 100 | 290 | 33 | 1 |
| Comparative | 1 | 90 | | 10 | | 250 | 275 | 33 | 3 |
| Example | 2 | 100 | | | | 100 | 290 | 33 | 1 |

TABLE 2

| | | Properties of Bottle | | | | | |
|---|---|---|---|---|---|---|---|
| | | p*) | Dispersion | Drop Stength | Gas-Barrier Property | Acetaldehyde Content (μg/l) | Separation Resistance of the Body |
| Example | 1 | 10.4 | Good | Good | 90 | 2.7 | Good |
| | 2 | 0.3 | Good | Good | 90 | 2.4 | Good |
| | 3 | 0.2 | Good | Good | 90 | 2.6 | Good |
| | 4 | 0.2 | Good | Good | 84 | 2.7 | Good |
| | 5 | 0.7 | Good | Good | 98 | 2.9 | Good |
| Comparative | 1 | 2.0 | Bad | Bad | 88 | 2.6 | Bad |
| Example | 2 | 0 | — | Good | 60 | 2.4 | Good |

*)Number of particles of polyethylene isophthalate resin (B) having a diameter of 0.1 micron or above contained, in 300 square microns of a section exposed by cutting the neck of the bottle in the matrix of polyethylene terephthalate resin (A)

exposed by cutting the neck of the bottle contains less than one particle of the polyethylene isophthalate resin (B) having a diameter of 0.1 micron or above in the polyethylene terephthalate resin (A) as the matrix.

2. The bottle as claimed in claim 1, wherein (a) when said bottle is filled with water substantially to its full capacity, closed tightly with an aluminum or plastic plug, and dropped with the bottom down five times on a concrete floor from a height of 2 m, no water leaks from the bottom of the bottle, and (b) when said bottle is charged with carbon dioxide in an amount creating an internal pressure of 5 atm., tightly closed, and stored in an atmosphere having a temperature of 23° C.±1° C., it takes at least 84 days for the weight of carbon dioxide in the bottle to drop to 82.5% of the initial weight of carbon dioxide.

3. A stretch blow bottle according to claim 1, wherein said bottle is a biaxially stretched blow molded product, and wherein said bottle has a body having a haze of less than 5% as determined by a method as prescribed in ASTM D 1003.

4. A bottle as claimed in claim 1, wherein said polyethylene terephthalate resin (A) contains on a molar basis at least 80% of terephthalic acid component and has an intrinsic viscosity [η] of 0.5 dl/g.

5. A bottle as claimed in claim 1, which has a capacity of at least 100 ml.

6. A bottle as claimed in claim 1, which is a biaxially stretch blow molded product.

7. A bottle as claimed in claim 1, which has a body having a haze of less than 5% as determined by a method as prescribed in ASTM D 1003.

8. A bottle as claimed in claim 1, wherein said polyester resin composition comprises: (A) 80 to 97% by weight of a polyethylene terephthalate resin and (B) 3 to 20% by weight of a polyethylene isophthalate resin.

* * * * *